US010895233B2

(12) United States Patent
Nair et al.

(10) Patent No.: US 10,895,233 B2
(45) Date of Patent: Jan. 19, 2021

(54) FUEL SYSTEM HAVING FIXED GEOMETRY FLOW REGULATING VALVE FOR LIMITING INJECTOR CROSS TALK

(71) Applicant: Caterpillar Inc., Deerfield, IL (US)

(72) Inventors: Siddharth Nair, Dunlap, IL (US); Manjunath Bannur Nagaraja, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/414,140

(22) Filed: May 16, 2019

(65) Prior Publication Data

US 2020/0362805 A1 Nov. 19, 2020

(51) Int. Cl.

| | |
|---|---|
| ***F02M 47/02*** | (2006.01) |
| ***F02M 47/04*** | (2006.01) |
| ***F02M 69/14*** | (2006.01) |
| ***F02M 69/18*** | (2006.01) |
| ***F02M 51/02*** | (2006.01) |
| ***F02M 63/00*** | (2006.01) |

(52) U.S. Cl.

CPC ..... *F02M 69/145* (2013.01); *F02M 47/025* (2013.01); *F02M 47/027* (2013.01); *F02M 47/043* (2013.01); *F02M 47/046* (2013.01); *F02M 51/02* (2013.01); *F02M 63/0029* (2013.01); *F02M 63/0078* (2013.01); *F02M 69/18* (2013.01)

(58) Field of Classification Search

CPC .... F02M 47/02; F02M 47/025; F02M 47/027; F02M 47/04; F02M 47/043; F02M 47/046; F02M 63/0005; F02M 63/0007; F02M 63/0028; F02M 63/0029; F02M 63/0056; F02M 63/0078; F02M 63/008

USPC ..... 123/446, 456, 472

See application file for complete search history.

(56) References Cited

U.S. PATENT DOCUMENTS

| | | | | |
|---|---|---|---|---|
| 1,329,559 | A | 2/1920 | Tesla | |
| 4,628,881 | A | 12/1986 | Beck et al. | |
| 4,948,049 | A | 8/1990 | Brisbon et al. | |
| 5,235,954 | A | 8/1993 | Sverdlin | |
| 6,622,701 | B2 | 9/2003 | Endo | |
| 7,278,593 | B2 | 10/2007 | Wang et al. | |
| 8,100,345 | B2 * | 1/2012 | Hotta | F02M 41/124 239/533.2 |

(Continued)

FOREIGN PATENT DOCUMENTS

| | | |
|---|---|---|
| DE | 102013003104 | 8/2014 |
| DE | 102015100650 | 8/2015 |

(Continued)

*Primary Examiner* — Erick R Solis

(74) *Attorney, Agent, or Firm* — Brannon Sowers & Cracraft

(57) ABSTRACT

A fuel system includes a plurality of fuel injectors each having an injection control valve assembly, a direct operated nozzle check, a high pressure nozzle supply passage, and a check control chamber. A common drain conduit fluidly connects to each of the plurality of fuel injectors to receive drained actuating fluid. A plurality of pressure regulating valves each having a static geometry are positioned fluidly between the common drain conduit and the check control chamber in one of the plurality of fuel injectors. Operating a fuel system according to the present disclosure includes limiting cross-talk between injectors in the fuel system.

18 Claims, 5 Drawing Sheets

(56) References Cited

U.S. PATENT DOCUMENTS

| | | | | |
|---|---|---|---|---|
| 9,291,138 | B2 * | 3/2016 | Morris | F02M 63/0215 |
| 9,638,422 | B2 | 5/2017 | Hall et al. | |
| 9,777,879 | B2 * | 10/2017 | Fujita | F02M 55/04 |
| 2006/0000450 | A1 * | 1/2006 | Ricco | F02M 63/0225<br>123/447 |
| 2008/0056914 | A1 * | 3/2008 | Usui | F02M 59/367<br>417/307 |

FOREIGN PATENT DOCUMENTS

| | | | |
|---|---|---|---|
| EP | 3112700 | B1 | 3/2018 |
| WO | 2015122537 | A1 | 8/2015 |

* cited by examiner

FUEL SYSTEM HAVING FIXED GEOMETRY FLOW REGULATING VALVE FOR LIMITING INJECTOR CROSS TALK

TECHNICAL FIELD

The present disclosure relates generally to a fuel system for an internal combustion engine, and more particularly to a fuel system where pressure regulating valves with static geometry are positioned between each of a plurality of fuel injectors and a common drain.

BACKGROUND

Internal combustion engine systems are well known and widely used for diverse purposes ranging from electrical power generation to providing torque for vehicle propulsion and powering compressors, pumps, and all manner of other machinery. In some internal combustion engine systems, notably compression ignition diesel engines, the fuel system can be the most complex part of the system, having a great many different rapidly moving parts, high fluid pressures and pressure changes, and intended service life in the tens of thousands of hours. A typical diesel fuel system can include a plurality of fuel injectors structured to directly inject metered amounts of pressurized fuel into cylinders in the engine. In some designs, the individual fuel injectors are equipped with so-called unit pumps or the like having a fuel pressurization plunger driven by an engine cam or by hydraulic fluid. In other instances, a common reservoir of pressurized fuel, typically referred to as a common rail, stores a volume of fuel at a pressure suitable for injection, and is maintained at that pressure by a dedicated high pressure fuel pump.

In either of these basic general designs the relatively high absolute pressures, and rapid and wide swings in pressure, can subject the fuel system equipment to wear, mechanical strain, great sensitivity to contaminants, and other factors that necessitate designing most systems relatively robust and machining components to tight tolerances. In systems utilizing a common rail or the like, operation of one fuel injector can sometimes affect operation of another fuel injector to detrimental effect. One known common rail fuel system, for example, is set forth in United States Patent Application Publication No. 2011/0297125 to Shafer et al.

SUMMARY OF THE INVENTION

In one aspect, a fuel system includes a plurality of fuel injectors, each of the plurality of fuel injectors including an injection control valve assembly and a direct operated nozzle check, and having a high pressure nozzle supply passage and a check control chamber formed therein. The fuel system further includes a common drain conduit fluidly connected to each of the plurality of fuel injectors to receive drained actuating fluid for each of the direct operated nozzle checks. The fuel system further includes a plurality of pressure regulating valves each having a static geometry and positioned fluidly between the common drain conduit and the check control chamber in one of the plurality of fuel injectors.

In another aspect, a fuel injector includes an injector body having a high pressure nozzle supply passage, a check control chamber, and a low pressure outlet formed therein. The fuel injector further includes a direct operated nozzle check, an injection control valve assembly, and a pressure regulating valve having a static geometry and positioned fluidly between the check control chamber and the low pressure outlet.

In still another aspect, a method of operating a fuel system includes moving an injection control valve in a first fuel injector in the fuel system from a closed position to an open position, and fluidly connecting a check control chamber in the first fuel injector to a low pressure outlet of the first fuel injector in response to the moving of the injection control valve. The method further includes producing a pulse of fluid pressure in response to the fluidly connecting of the check control chamber to the low pressure outlet, and feeding the pulse of fluid pressure to a pressure regulating valve having a static geometry and positioned fluidly between the check control chamber in the first fuel injector and a second fuel injector in the fuel system. The method still further includes limiting cross-talk between the first fuel injector and the second fuel injector based on an attenuation of the pulse of fluid pressure by the pressure regulating valve.

DETAILED DESCRIPTION

Figure 1:
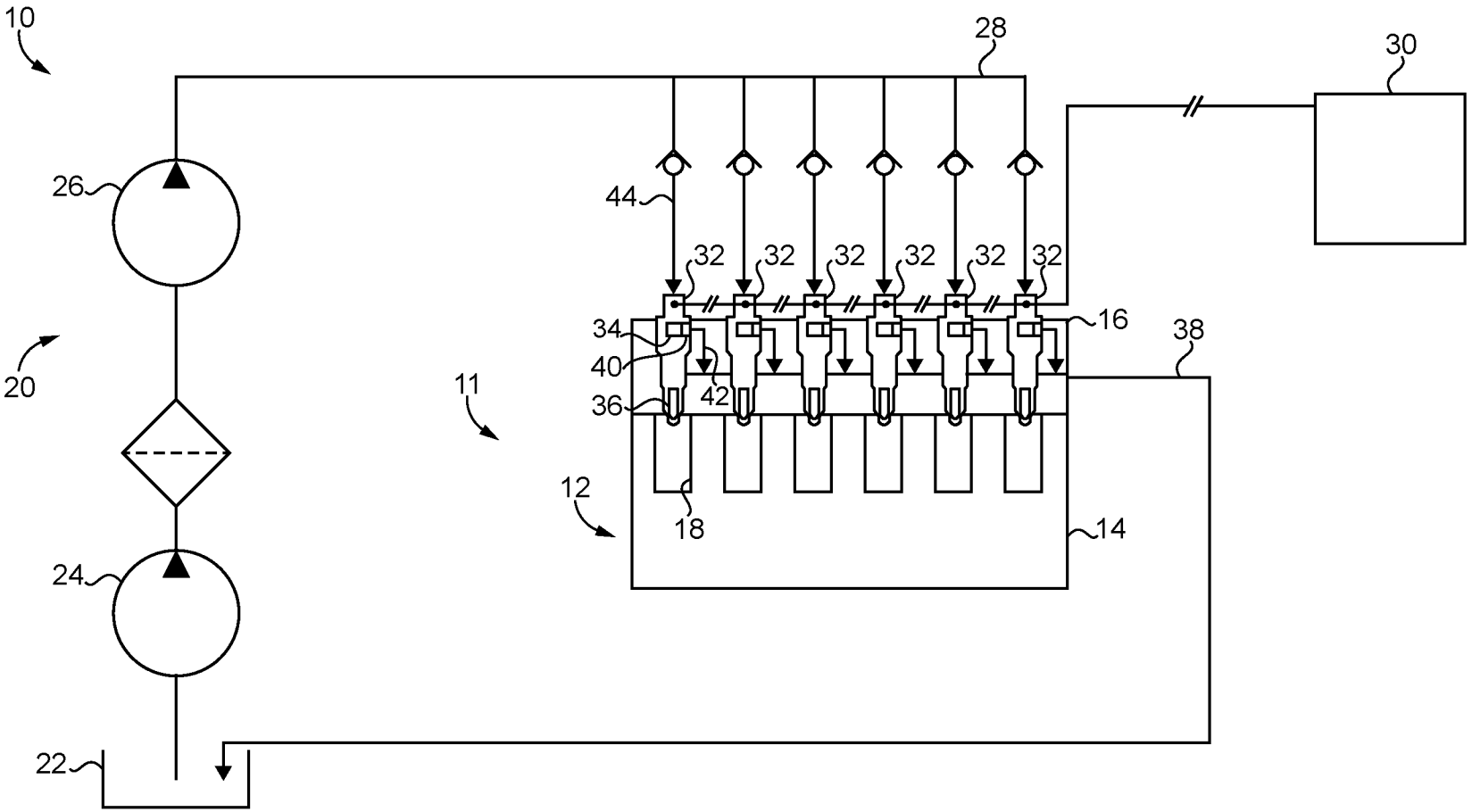
FIG. 1 is a diagrammatic view of an internal combustion engine system, according to one embodiment.

Referring to FIG. 1, there is shown an internal combustion engine system 10 according to one embodiment, and including an internal combustion engine 11 including an engine housing 12 having a cylinder block 14 and an engine head 16. A plurality of combustion cylinders 18 are formed in cylinder block 14 and can include any number of cylinders in any suitable arrangement such as an in-line arrangement, a V-configuration, or still another. A plurality of pistons (not shown) will be positioned one within each of combustion cylinders 18 and movable between a top dead center position and a bottom dead center position, in a typical four-cycle pattern. Internal combustion engine system 10 further includes a fuel system 20 structured to supply and pressurize a fuel for delivery into combustion cylinders 18. In an implementation, the fuel includes diesel distillate fuel suitable for compression ignition, however, the present disclosure is not thereby limited and other suitable fuels such as biodiesel, blends, et cetera, may be used, as well as a different ignition strategy such as spark ignition.

Fuel system 20 includes a fuel supply or tank 22, and equipment for conveying fuel from tank 22 to combustion cylinders 18 including a low pressure transfer pump 24, a high pressure pump 26, and a common rail 28 structured to receive fuel pressurized by high pressure pump 26 and store the same for delivery to a plurality of fuel injectors 32 by way of a plurality of fuel supply lines 44. Fuel supply lines 44 can be formed at least partially within engine head 16, and connected with each of fuel injectors 32 by way of so-called quill connectors or the like, or connected by way of any other suitable strategy. Fuel system 20 is a common rail fuel system in a practical implementation, however, the present disclosure is not thereby limited and could have a unit pump associated with or part of each one of fuel injectors 32. In still another configuration a number of unit pumps less than the number of fuel injectors could be used, in conjunction with a plurality of fuel pressure accumulators each structured to store pressurized fuel for delivery to less than all of fuel injectors 32 in fuel system 20.

Each of fuel injectors 32 includes an injection control valve assembly 34 and a direct operated nozzle check 36. Injection control valve assembly 34 is electrically actuated, and direct operated nozzle check 36 is hydraulically actuated. An electronic control unit 30 may be in control communication with each injection control valve assembly 34 associated with each of fuel injectors 32. Fuel system 20 also includes a common drain conduit 38 fluidly connected to each of fuel injectors 32 to receive drained actuating fluid for each of direct operated nozzle checks 36. A drain line 42 may extend between each fuel injector 32 and common drain conduit 38, and may be formed in engine head 16, for example. Although not depicted in FIG. 1, a check valve could be positioned fluidly between internal combustion engine 11 and tank 22 within common drain conduit 38 to prevent backflow of liquid or gas from tank 22. It should be appreciated that fuel injectors 32 may be interchangeable with one another in internal combustion engine system 10, and also that discussion herein of features or functionality of any one of fuel injectors 32 can be understood to refer by way of analogy to any other of fuel injectors 32. Each of fuel injectors 32 further includes, or is associated with, a pressure regulating valve 40 positioned fluidly between common drain conduit 38 and one of fuel injectors 32. Each pressure regulating valve 40 may have a static geometry, the significance of which will be apparent from the following description.

Figure 2:
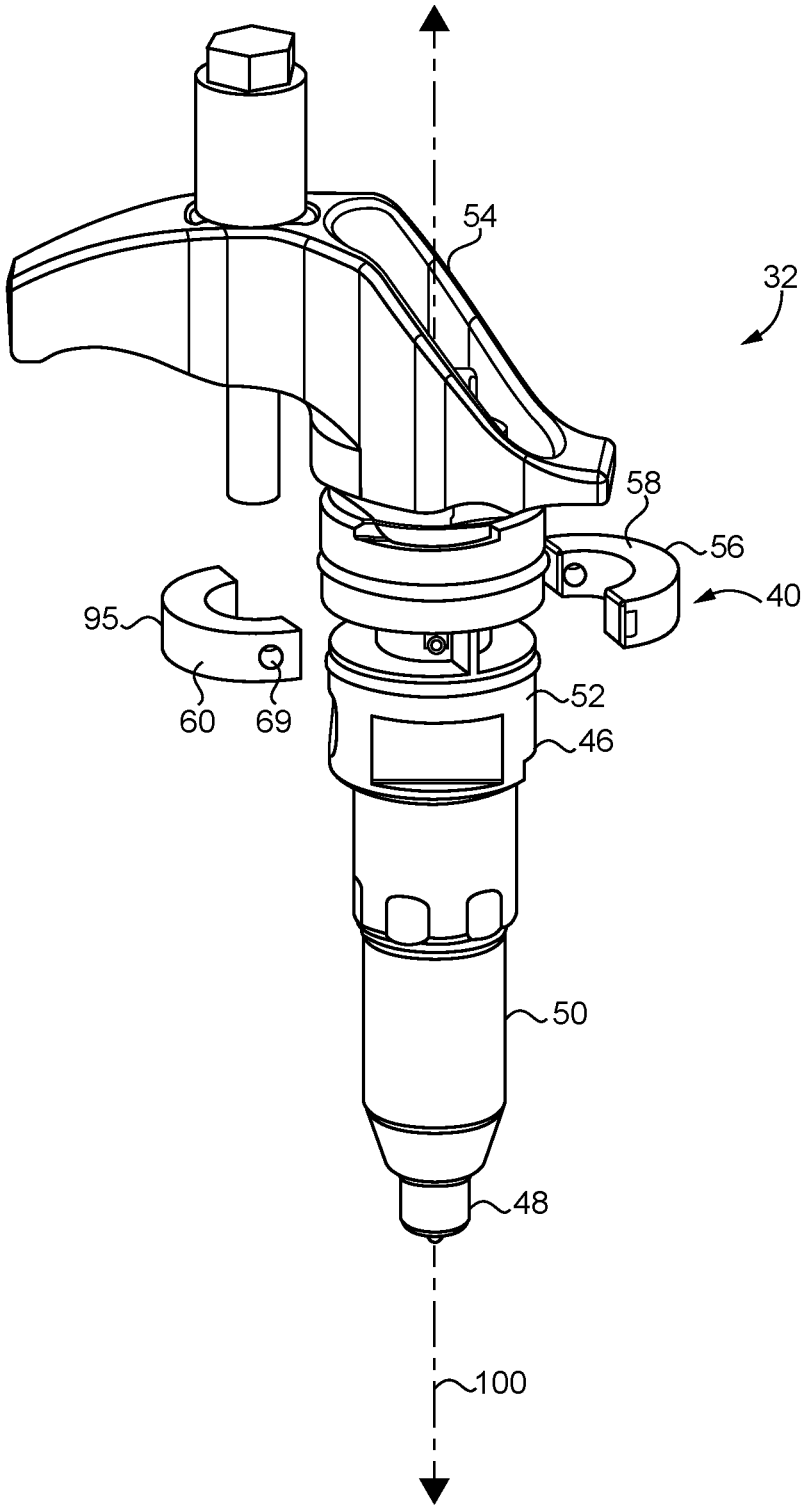
FIG. 2 is a diagrammatic view of a fuel injector, according to one embodiment.

Referring also now to FIG. 2, there are shown additional features of fuel injector 32 including an injector body 46. Injector body 46 includes generally the components of fuel injector 32 separate from internal moving parts, and includes a nozzle piece 48, a casing 50, and a base piece 52. Fuel injector 32 also includes a coupling or attachment assembly 54 to assist in mounting fuel injector 32 in internal combustion engine 11. Also shown disassembled from injector body 46 is pressure regulating valve 40. Pressure regulating valve 40 can include a valve body 56 having a first arcuate valve body piece 58 and a second arcuate valve body piece 60. Fuel injector 32 includes a low pressure outlet 69, which in the illustrated embodiment is formed in valve body 56. It can also be noted from FIG. 2 that valve body 56 forms part of an outer surface 95 of fuel injector 32. In other embodiments, valve body 56 of flow regulating valve 40 might be internal to fuel injector 32. Fuel injector 32 and injector body 46 define a longitudinal axis 100.

Figure 3:
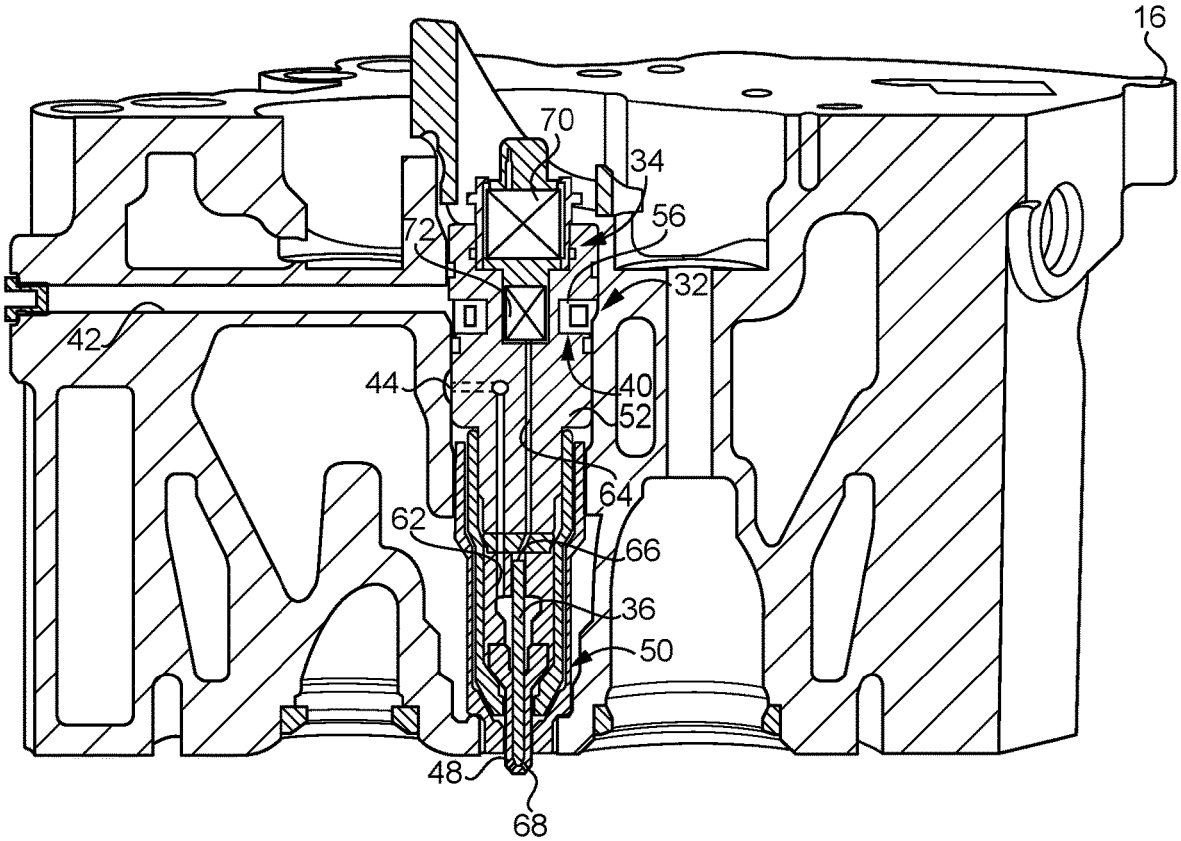
FIG. 3 is a sectioned view through a portion of the internal combustion engine system of FIG. 1.

Referring also now to FIG. 3, as noted above fuel injector 32 may be positioned at least partially within engine head 16 and there is shown supply line 44 connecting to fuel injector 32. Injector body 46 has formed therein a high pressure nozzle supply passage 62 that extends between a high pressure inlet (not numbered) to injector body 46 from supply line 44 and a plurality of spray orifices 68 formed in nozzle piece 48. Fuel system 20 is a single-fluid system, employing fuel for injection and also actuation of components. In other embodiments, a two-fluid system might be used such as where a fluid different from fuel for injection is used to actuate internal fuel injector components. Nozzle check 36 is movable between a closed position, approximately as shown, blocking spray orifices 68, and an open position where spray orifices 68 are in fluid communication with supply line 44 by way of high pressure nozzle supply passage 62. A check control chamber 66 is also formed in injector body 46, and may be fluidly connected with high pressure nozzle supply passage 62 according to generally known internal fuel injector geometry to provide high pressure actuating fluid, in the illustrated case pressurized fuel, to a back end of nozzle check 36 to actuate nozzle check 36 closed. Injector body 46 also has formed therein a low pressure drain path 64 that extends from check control chamber 66 through base piece 52 toward low pressure outlet 69. Injection control valve assembly 34 is positioned operably between check control chamber 66 and low pressure outlet 69, to selectively connect check control chamber 66 to low pressure outlet 69 to relieve closing hydraulic pressure on nozzle check 36. Actuating injection control valve assembly 34 thus permits a pressure of fuel supplied from nozzle supply passage 62 to act on opening hydraulic surfaces (not numbered) of nozzle check 36, causing nozzle check 36 to lift to an open position. When injection control valve assembly 34 is operated to block check control chamber 66 from low pressure outlet 69, high pressure may return to check control chamber 66 to move nozzle check 36 back to its closed position.

Figure 4:
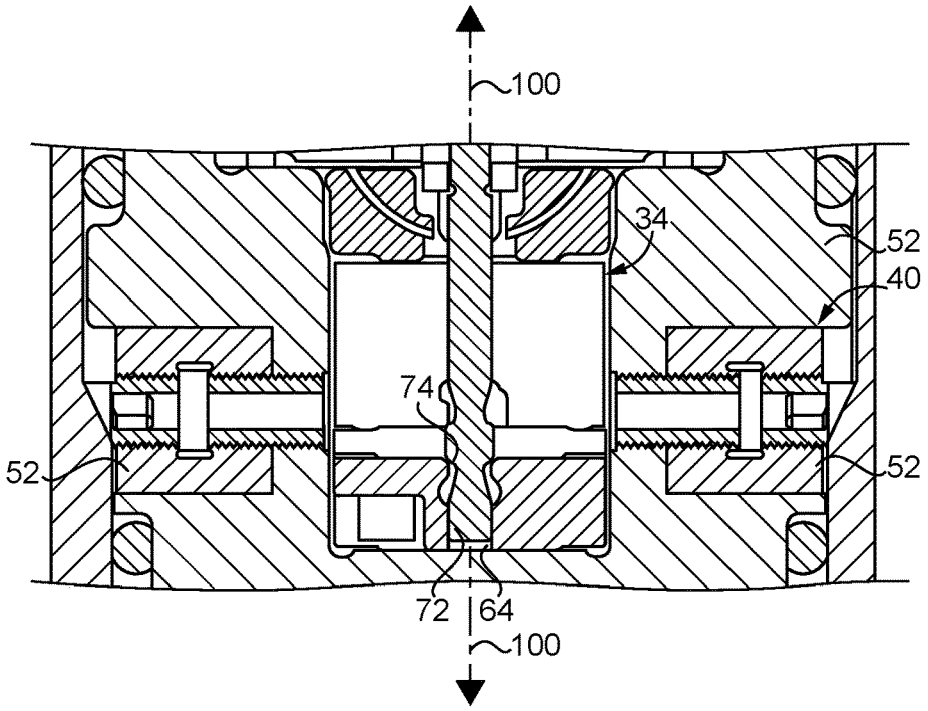
FIG. 4 is a longitudinal sectioned view through a portion of the fuel injector of FIG. 2.
Figure 5:
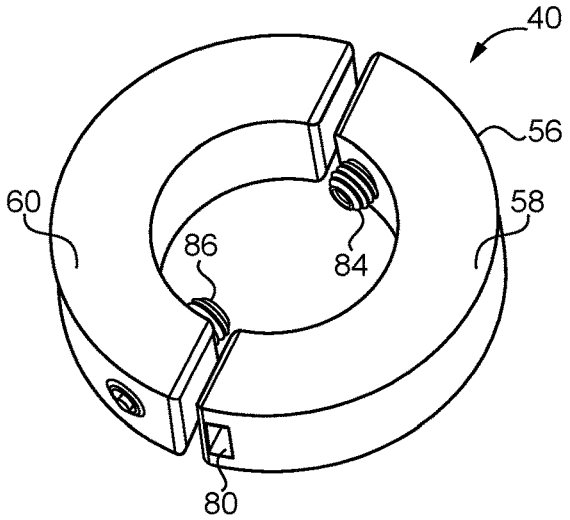
FIG. 5 is an isometric view of a pressure regulating valve, according to one embodiment.
Figure 6:
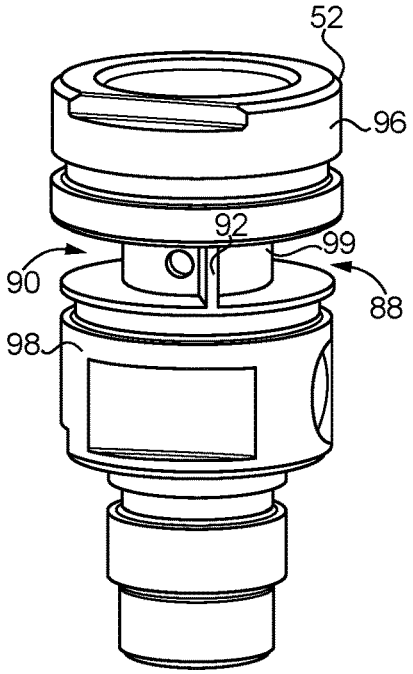
FIG. 6 is an isometric view of a portion of the fuel injector of FIG. 2.
Figure 7:
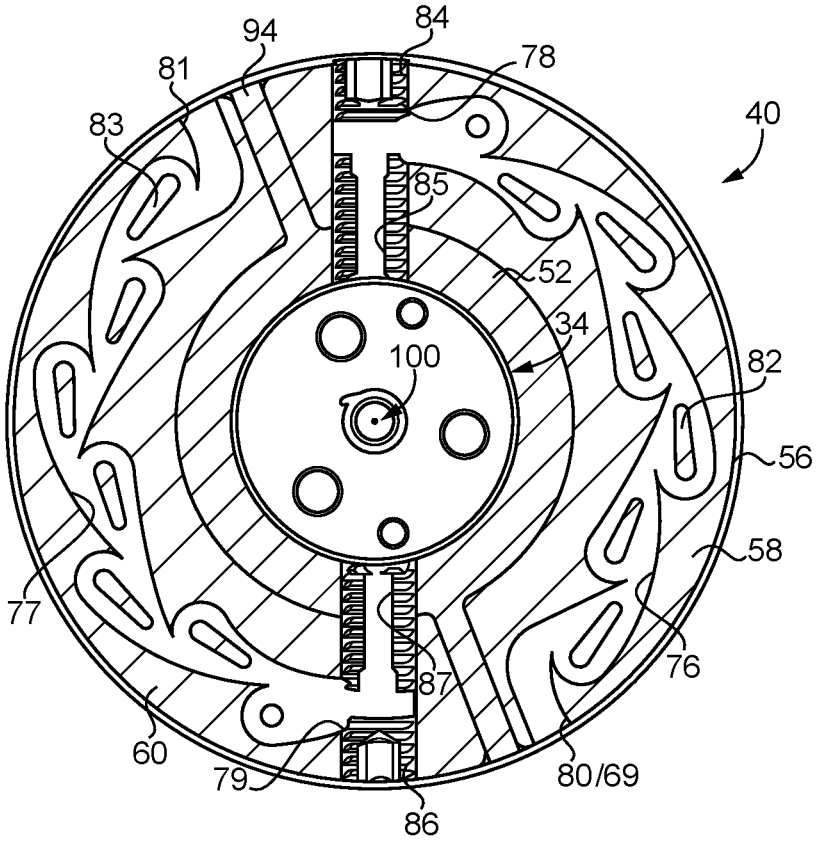
FIG. 7 is an axial sectioned view through the fuel injector of FIG. 2.

Referring also now to FIG. 4, there are shown some features of injection control valve assembly 34 and pressure regulating valve 40 in greater detail. Injection control valve assembly 34 includes an electrical actuator or solenoid 70, and a valve 72. Valve 72 is movable in response to energizing or deenergizing electrical actuator 70, to move valve 72 away from, or into contact with, a valve seat 74. In the illustrated embodiment, valve 72 may be biased closed to block valve seat 74, and thus prevent fluid communication between low pressure drain path 64 and low pressure outlet 69. When electrical actuator 70 is operated to move valve 72 from valve seat 74, a decrease in pressure in low pressure drain path 64 and control chamber 66 enables nozzle check 36 to lift. Opening injection control valve assembly 34 and lifting nozzle check 36 produces a pulse of fluid pressure, the significance of which will be apparent from the following description. In FIG. 4 it can also be seen that valve body 56 is generally centered on longitudinal axis 100 and extends circumferentially around longitudinal axis 100. Referring also now to FIG. 7, there is shown an axial section view taken generally through valve body 56 and illustrating still further features.

Pressure regulating valve 40 also includes a flow race 76 formed in valve body 56, and extending between an inlet 78 internal to fuel injector 32 and an outlet 80 connecting to common drain conduit 30. As illustrated in FIG. 7, outlet 80 is coincident with low pressure outlet 69 of injector body 46 and fuel injector 32 generally. Flow race 76 includes a first flow race 76 formed in first arcuate body piece 58 and extending partially circumferentially around longitudinal axis 100. A second flow race 77 is formed in second arcuate valve body piece 60, and likewise extends partially circumferentially around longitudinal axis 100. It can be appreciated that a variety of different geometries and valve configurations might be constructed according to the teachings herein. Flow regulating valve 40 has a split configuration in the illustrated embodiment, where two separate valve body pieces functioning as two separate pressure regulating valves are provided. In other instances, only a single pressure regulating valve might be used. Second flow race 77 extends between a second inlet 79 internal to fuel injector 32 and injector body 46, and a second outlet 81 that can form another low pressure outlet of injector body 46 and fuel injector 32 generally. Also in the illustrated embodiment, flow race 76 and flow race 77, and first and second arcuate valve body pieces 58 and 60, are substantially identical to one another. In other instances, the valve body pieces and internal flow races might have different configurations, mirror image configurations for instance. Also in the illustrated embodiment, valve body 56 includes a plurality of pillars 82 located within flow race 76, and another plurality of pillars 83 located in flow race 77. Pressure regulating valve 40 further includes a first fitting 84 attaching first arcuate valve body piece 58 to base piece 52, and a second fitting 86 attaching second arcuate valve body piece 60 to base piece 52. First fitting 84 can include a threaded fitting and has a first bore 85 formed therein connecting low pressure drain path 64 to inlet 78. Second fitting 86 has a second bore 87 formed therein connecting low pressure drain path 64 to second inlet 79. It will be recalled that inlet 78, which can include a first inlet, is internal to fuel injector 32, and inlet 79 may be a second inlet, also internal to fuel injector 32. Bore 85 may be plugged such that fluid fed through bore 85 can be directed into flow race 76. Bore 87 can also be plugged such that fluid fed through bore 87 is directed into flow race 77. In pressure regulating valve 40 it will be appreciated that the geometry of the valve is fixed, meaning that no moving parts are employed. It will also be appreciated that flow races in valve 40, and other valves contemplated herein, can be internal to a uniform single piece of material formed, for example, by 3-D printing or another additive manufacturing process. The purpose, significance, and effects of pressure regulating valve 40 in a fuel system according to the present disclosure, are further discussed herein.

INDUSTRIAL APPLICABILITY

Referring to the drawings generally, it will be appreciated that pressure regulating valves can have a variety of different geometries and arrangements and be resident in or arranged outside of a fuel injector. Internal structures of a flow regulating valve in a fuel injector according to the present disclosure can be fixed, with no moving parts, and structured to enable substantially unrestricted flow in a first direction but restricted flow in an opposite direction. In the configuration depicted in FIG. 7 pressure regulating valve 40 can be understood to define a flow-biasing direction extending downstream of the check control chamber in the corresponding fuel injector, in other words permitting substantially unrestricted flow out of the check control chamber and away from the fuel injector toward a common drain conduit, but restricting flow in an opposite direction.

Observations have been made in certain fuel systems that cross-talk can occur between fuel injectors, as further discussed herein. Operating a fuel system according to the present disclosure, such as fuel system 20, can include moving injection control valve 72 in a first fuel injector 32 from a closed position to an open position, thereby fluidly connecting check control chamber 66 to low pressure outlet 69 in response to the moving of injection control valve 72, and causing nozzle check 36 to lift. Fluidly connecting check control chamber 66 to low pressure outlet 69 can produce a pulse of fluid pressure as the fluid pressure prevailing in drain path 64 and a relatively small quantity of fluid can be communicated past valve seat 74. Certain prior fuel systems included one check valve between a common drain conduit and a fuel tank. Accordingly, in at least some instances, a pulse of fluid pressure produced by actuating an injection control valve to start fuel injection, or potentially to end fuel injection in a known design, could be communicated between or among fuel injectors. Such pulses of fluid pressure could have the undesired effect of popping open an injection control valve in a fuel injector in response to a pulse of fluid pressure from actuating another fuel injector. Such cross-talk could have the undesirable effect of degrading performance in some instances. According to the present disclosure, a pulse of fluid pressure produced in this general manner is fed to a pressure regulating valve such as pressure regulating valve 40, positioned fluidly between check control chamber 66 in a first fuel injector 32 and a second fuel injector in fuel system 20. Feeding the pulse of fluid pressure to pressure regulating valve 40 limits cross-talk between fuel injectors based on an attenuation of an amplitude of the pulse of fluid pressure by pressure regulating valve 40. Where a pressure regulating valve has a configuration as in FIG. 7, as a result of a flow-biasing direction extending downstream of check control chamber, back pressure is produced in opposition to the pulse of fluid pressure. The back pressure might be about 550 KPa, for example. In other embodiments, an arrangement of pressure regulating valves could be reversed, such that a flow-biasing direction extends upstream toward check control chamber 66. In such a configuration, rather than producing back pressure that opposes outputting a pulse of fluid pressure from a fuel injector, back pressure could be produced in an opposite direction, enabling one fuel injector to be desensitized to pulses of fluid pressure that might otherwise be inputted from other fuel injectors. The chosen configuration and arrangement of pressure regulating valves could be different in different systems, and embodiments are even contemplated where some fuel injectors in a fuel system could be associated with a pressure regulating valve having a downstream flow-biasing direction while others are associated with a pressure regulating valve having an upstream flow-biasing direction.

Those skilled in the art will recognize a pressure regulating valve having a fixed geometry as in the present disclosure as being a type of valve commonly referred to as a Tesla valve and by other known terms. It is contemplated that other pressure regulating valve geometries than those disclosed can be envisioned where internal flow surfaces achieve similar results. In an implementation, an internal contour of flow races in a pressure regulating valve according to the present disclosure is varied according to a first geometric attribute, a second geometric attribute, and a third geometric attribute, between an inlet and an outlet to the flow race. A first geometric attribute might be height of a flow passage, a second geometric attribute might be a width of the flow passage, and a third geometric attribute might be the presence of internal flow-affecting structures such as pillars 82, 83. Such pillars can be positioned within a fluid flow path and are contoured to assist in facilitating flow in one direction through a flow race but limiting flow in an opposite direction, according to known hydrodynamic principles. A flow restriction orifice varying in geometry in only two dimensions, for example, would not be understood to be varied according to first, second, and third geometric attributes.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel system comprising:

a plurality of fuel injectors, each of the plurality of fuel injectors including an injection control valve assembly and a direct operated nozzle check, and having a high pressure nozzle supply passage and a check control chamber formed therein;

a common drain conduit fluidly connected to each of the plurality of fuel injectors to receive drained actuating fluid for each of the direct operated nozzle checks; and a plurality of pressure regulating valves each having a static geometry and positioned fluidly between the common drain conduit and the check control chamber in one of the plurality of fuel injectors, each pressure regulating valve defining an asymmetrical flow-biasing direction.

2. The fuel system of claim 1 wherein each of the plurality of pressure regulating valves is resident in one of the plurality of fuel injectors.

3. The fuel system of claim 2 wherein each of the plurality of pressure regulating valves includes a valve body forming an outer surface of the corresponding one of the plurality of fuel injectors.

4. The fuel system of claim 3 wherein each of the plurality of pressure regulating valves includes a flow race extending between an inlet internal to the fuel injector and an outlet connecting to the common drain conduit.

5. The fuel system of claim 4 wherein:

each of the plurality of fuel injectors defines a longitudinal axis; and the flow race extends circumferentially around the longitudinal axis, and a plurality of pillars are formed by the valve body and located within the flow race.

6. The fuel system of claim 4 wherein:

the valve body includes a first arcuate valve body piece and a second arcuate valve body piece, and the flow race is formed in the first arcuate valve body piece; and each of the plurality of pressure regulating valves includes a second flow race formed in the second valve body piece and extending between a second inlet internal to the fuel injector and a second outlet connecting to the common drain conduit.

7. The fuel system of claim 6 wherein:

each of the plurality of fuel injectors includes a base piece, and a low pressure drain path extending from the check control chamber through the base piece; and each of the plurality of pressure regulating valves includes a first threaded fitting attaching the first arcuate valve body piece to the base piece and having a first bore formed therein connecting the low pressure drain path to the first inlet internal to the fuel injector, and a second threaded fitting attaching the second arcuate valve body piece to the base piece and having a second bore formed therein connecting the low pressure drain path to the second inlet internal to the fuel injector.

8. The fuel system of claim 1 wherein the flow-biasing direction extends downstream toward the common drain conduit.

9. A fuel injector comprising:

an injector body having a high pressure nozzle supply passage, a check control chamber, and a low pressure outlet formed therein;

a direct operated nozzle check;

an injection control valve assembly; and a pressure regulating valve having a static geometry and positioned fluidly between the check control chamber and the low pressure outlet, the pressure regulating valve includes a valve body having a flow race formed therein and extending between an inlet internal to the injector body and an outlet coincident with the low pressure outlet of the injector body, and the valve body includes a first valve body piece having the flow race formed therein, and a second valve body piece having a second flow race formed therein.

10. The fuel injector of claim 9 wherein the static geometry of the pressure regulating valve includes an internal contour of the flow race that is varied according to a first geometric attribute, a second geometric attribute, and a third geometric attribute, between the inlet and the outlet.

11. The fuel injector of claim 10 wherein the valve body includes a plurality of pillars within the flow race.

12. The fuel injector of claim 9 wherein:

the injector body has a low pressure drain path formed therein and extending from the check control chamber; and the pressure regulating valve further includes a first fitting fluidly connecting the low pressure drain path to the first flow race and a second fitting fluidly connecting the low pressure drain path to the second flow race.

13. The fuel injector of claim 12 wherein:

the first fitting includes a first threaded fitting extending through the first valve body piece and the injector body and attaching the first valve body piece to the injector body; and the second fitting includes a second threaded fitting extending through the second valve body piece and the injector body and attaching the second valve body piece to the injector body.

14. The fuel injector of claim 9 wherein the injector body includes a base piece having a first cutout and a second cutout formed therein, and wherein the first valve body piece has an arcuate shape and is positioned within the first cutout and the second valve body piece has an arcuate shape and is positioned within the second cutout.

15. The fuel injector of claim 14 wherein the base piece includes a first segment, a second segment, and a control valve segment extending between the first segment and the second segment, and wherein the first cutout and the second cutout are each defined by the first segment, the second segment, and the control valve segment, and the injection control valve assembly is positioned at least partially within the control valve segment.

16. A method of operating a fuel system comprising:

moving an injection control valve in a first fuel injector in the fuel system from a closed position to an open position;

fluidly connecting a check control chamber in the first fuel injector to a low pressure outlet of the first fuel injector in response to the moving of the injection control valve;

producing a pulse of fluid pressure in response to the fluidly connecting of the check control chamber to the low pressure outlet;

feeding the pulse of fluid pressure to a pressure regulating valve having a static geometry and positioned fluidly between the check control chamber in the first fuel injector and a second fuel injector in the fuel system, the pressure-regulating valve including a flow race between an inlet of the pressure-regulating valve and an outlet of the pressure-regulating valve, the pressure-regulating valve further including a plurality of pillars disposed within the race, and the pulse of fluid pressure being attenuated by the race and pillars of the pressure-regulating valve; and limiting cross-talk between the first fuel injector and the second fuel injector based on the attenuation of the pulse of fluid pressure by the pressure regulating valve.

17. The method of claim 16 wherein the pressure regulating valve is resident in the first fuel injector.

18. The method of claim 17 wherein the pressure regulating valve produces a backpressure in opposition to the pulse of fluid pressure.

* * * * *